United States Patent [19]

Hagner et al.

[11] 4,113,630

[45] Sep. 12, 1978

[54] ARTICLE FOR CONDITIONING FABRICS

[75] Inventors: Clifford K. Hagner; Richard B. Wissel, both of Cincinnati, Ohio

[73] Assignee: The Procter & Gamble Company, Cincinnati, Ohio

[21] Appl. No.: 781,385

[22] Filed: Mar. 25, 1977

[51] Int. Cl.[2] ..... D06M 13/46

[52] U.S. Cl. ..... 252/8.6; 206/0.5; 252/8.8

[58] Field of Search ..... 252/8.6, 8.8; 206/0.5

[56] References Cited

U.S. PATENT DOCUMENTS

| | | | |
|---|---|---|---|
| 3,632,396 | 1/1972 | Zamora | 252/8.6 |
| 3,676,199 | 7/1972 | Hewitt et al. | 428/262 |
| 3,686,025 | 8/1972 | Morton | 252/8.8 |
| 3,936,537 | 2/1976 | Baskerville et al. | 252/8.8 |

*Primary Examiner*—William E. Schulz

*Attorney, Agent, or Firm*—Steven J. Goldstein; Robert B. Aylor; Richard C. Witte

[57] ABSTRACT

A laundry article utilizing a water-insoluble substrate is disclosed. This article is added to the automatic washer, and is subsequently carried into the dryer with the fabrics in order to provide them with fabric softening and static-control benefits. By forming the laundry substrate articles such that the softening and static-control mixture penetrates into the substrate and extends above the substrate to a height of from about 1/32 inch to about ½ inch, improved softening and static-control performance can be attained and lower levels of softening and static-control actives may be used. A method for obtaining softening and static-control benefits, using these articles, is also disclosed.

23 Claims, No Drawings

ARTICLE FOR CONDITIONING FABRICS

BACKGROUND OF THE INVENTION

The desirability of providing fabric softening and static control benefits to fabrics which are laundered and are then dried in an automatic clothes dryer is well known. However, since the compositions which provide fabric softening and static control benefits are generally separate from the detergent composition used to clean the fabrics, their use, in order to obtain these benefits, results in some degree of inconvenience to the person doing the laundry. For example, the detergent composition must be measured out and added at the start of the washing cycle, while the fabric softening and static control composition requires a separate measuring operation and is usually added to the washing machine at a different time during the washing cycle. Thus, the use of most softening/static control compositions requires the inconvenience of additional pouring and measuring operations, as well as the necessity of having to remain close to the washing machine during its operation, so that the composition may be added at the proper time.

Various solutions to this problem have been proposed in the art. Detergent compositions, as well as fabric conditioning compositions, have been separately incorporated with water-insoluble substrates for addition to the washing machine or the automatic dryer during the laundering process. These compositions have the advantage of eleminating the additional pouring and measuring steps generally attendant to the use of conventional powder and liquid softening and static control compositions, thereby reducing the chance of spillage and waste. U.S. Pat. No. 3,694,364, Edwards, issued Sept. 26, 1972, teaches the use of an amine-coated modified cellulosic substrate which releasably contains a detergent composition. The substrate is added to the wash solution in order to introduce the detergent composition into the washing system, while the substrate scavenges and adsorbs undesirable dirt and anionic dyes which are present in the laundry solution. However, the use of such a composition still requires the separate measuring and addition of the fabric conditioning/static control composition at a later time in the laundering cycle, if such a benefit is desired.

Many patents, such as U.S. Pat. No. 3,442,692, Gaiser, issued May 6, 1969; U.S. Pat. No. 3,632,396, Zamora, issued Jan. 4, 1972; U.S. Pat. No. 3,686,025, Morton, issued Aug. 22, 1972; and U.S. Pat. No. 3,936,538, Marshall et al, issued Feb. 3, 1976, teach methods of incorporating various fabric conditioning compositions, such as static control compositions, on insoluble substrates. When these substrates are added to an automatic dryer, or to the rinse cycle of an automatic washer, the fabrics being laundered receive the fabric conditioning benefit. However, even with these compositions, the detergent composition required to clean the fabrics, must be separately measured out and added to the laundry solution, and the fabric conditioning substrate compositions must be added at another time during the laundering process.

One possible solution to this inconvenience would be to include the fabric conditioning agent in the detergent composition itself. However, additional problems result when various quaternary ammonium compounds, which are known in the art to possess beneficial antistatic properties, are placed in detergent compositions which contain anionic surfactants, which are commonly employed in the laundering of fabrics. The opposite electrical charges of the two compounds lead not only to the mutual attraction of the surfactants, which results in the formation of insoluble compounds and the depletion of the respective materials, but also to reversal of the electrical charges upon fabric surfaces exposed to the wash liquid. This reversal results in undesirable effects such as increased soil redeposition on fabrics and poor soil removal. U.S. Pat. No. 3,936,537, Baskerville, Jr. et al, issued Feb. 3, 1976, discloses particulate detergent compositions, having static control particles within a specific size range, which permit the incorporation of quaternary ammonium fabric conditioning compounds into granular or powder-form detergent compositions, and which yield both cleaning and static reduction benefits to fabrics washed therewith. The attainment of effective static control benefits using such compositions depends upon the entrapment of the quaternary ammonium compound-containing particles in the fabrics during the washing process, which, under certain conditions, may result in the undesirable buildup of such particles in laundered fabrics or in various parts of the automatic washer and dryer. In addition, a certain amount of these quaternary ammonium-containing particles will fail to become so entrapped and, thus, their static control effect will be lost.

It is thus an object of the present invention to provide a substrate article which efficiently yields fabric conditioning benefits when used in the laundering process.

It is a further object of the present invention to formulate a laundry article which may provide both cleaning and fabric conditioning benefits to fabrics laundered with it.

It is also an object of this invention to provide a convenient, easy to use laundry article, which may be used to yield fabric-care benefits in both the automatic washer and the automatic dryer.

It is still further object of the present invention to provide a method for obtaining both cleaning and static control benefits for laundered fabrics, utilizing a substrate detergent composition.

SUMMARY OF THE INVENTION

According to the present invention there is provided a substrate laundry article, which efficiently provides fabric softening and static control benefits, and which is used in both the automatic washer and the automatic dryer during the laundering process, consisting essentially of a water-insoluble substrate, carrying an effective amount of an intimate mixture, having a maximum solubility in water of 50 ppm at 25° C and a softening point of from 100° to 200° F, consisting essentially of:

(a) from about 10 to 90% by weight of quaternary ammonium fabric conditioning compounds having the formula $[R_1R_2R_3R_4N]^+Y^-$, wherein at least 1, and not more than 2, of the $R_1$, $R_2$, $R_3$, or $R_4$ groups is an organic radical containing a group selected from a $C_{12}$ to $C_{22}$ aliphatic radical, or an alkyl phenyl or alkyl benzyl radical having 10 to 16 carbon atoms in the alkyl chain, the remaining group or groups being selected from $C_1$ to $C_4$ alkyl, $C_2$ to $C_4$ hydroxy alkyl, and cyclic structures in which the nitrogen atom forms part of the ring, Y constitutes an anionic radical selected from the group consisting of hydroxide, halide, sulfate, methyl sulfate, and phosphate ions; and (b) from about 10 to 90% by weight of a dispersion inhibitor, being a solid organic material having a maximum solubility in water of 50 ppm at 25° C and a softening point in the range of 100° F to 200° F, said material being selected from the group consisting of paraffinic waxes, cyclic and acyclic mono- and polyhydric alcohols, substituted and unsubstituted aliphatic carboxylic acids, esters of cyclic and acyclic mono- and polyhydric alcohols and acids, condensates of $C_2$ to $C_4$ alkylene oxide with any of the foregoing types of materials, whether or not said materials themselves meet the above solubility and softening point limits, and mixtures thereof;

said mixture penetrating into the substrate and extending above ths substrate to a height of from about 1/32 inch to about ½ inch.

Preferred articles additionally contain a water-soluble surface-active agent, particularly one selected from the group consisting of anionic surfactants, nonionic surfactants, zwitterionic surfctants and mixtures thereof.

In addition to the substrate, surfactant, fabric conditioning and dispersion inhibitor components, the laundry articles of the present invention may also include other components normally found in detergent compositions. Examples of such components include: detergency builder salts, fabric softening agents, soil-suspending agents, corrosion inhibitors, dyes, optical brighteners, germicides, fillers, pH adjusting agents, enzymes, perfumes, and the like.

A method for providing fabric conditioning benefits to laundered fabrics, utilizing the substrate compositions of the present invention in both the automatic washer and dryer, is also disclosed.

DETAILED DESCRIPTION OF THE INVENTION

The laundry articles of the present invention comprise a water-insoluble substrate and an intimate mixture of a quaternary ammonium fabric conditioning compound and a dispersion inhibitor loaded onto the substrate in a specific manner. The articles of the present invention constitute an improvement of those disclosed in concurrently filed U.S. Patent Application Ser. No. 781,399, Jones, Article for Conditioning Fabrics, incorporated herein by reference. Preferred articles also contain a detergent composition comprising a water-soluble surface-active agent component. These preferred articles are described in U.S. Patent Application Ser. No. 781,400, Jones and Kingry, filed of even date, incorporated herein by reference. Each of these components will be discussed in etail hereinafter. Substrates The substrates employed herein are water-insoluble and are solid or substantially solid materials. They can be dense or open in structure, preferably the latter. Examples of suitable materials which can be used as a substrate herein include, among others, foam, foil, sponge, paper, woven cloth, and nonwoven cloth. Preferred substrates are made from a flexible material and include those made from paper, woven cloth and nonwoven cloth. The term "cloth", as used herein, means a woven or nonwoven fabric or cloth used as a substrate, in order to distinguish it from the term "fabric" which means the textile fabric which is desired to be laundered. Absorbent capacity, thickness, or fiber density are not limitations on the substrates which can be used herein, as long as the substrates exhibit sufficient wet-strength so as to maintain their structural integrity through the complete washing and drying cycles in which they are used. Further, the substrates must have certain thermal stability characteristics, i.e., they should not have a melting point or ignite at temperatures below 300° F, preferably about 425° F, in order to permit their use in automatic clothes dryers. Preferably, the substrates employed herein are wet-strength paper or nonwoven cloth.

Paper substrates which can be employed herein encompass the broad spectrum of known paper structures and are not limited to any specific papermaking fiber or wood pulp. Thus, the fibers derived from soft woods, hard woods, or annual plants (e.g., bagasse, cereal straw, and the like), and wood pulps, such as bleached or unbleached kraft, sulfite, soda ground wood, or mixtures thereof, can be used. Moreover, the paper substrates which can be employed herein are not limited to specific types of paper, as long as the paper exhibits the necessary wet-strength and thermal stability.

A specific example of a paper substrate preferred herein is a two-ply paper having a basis weight of about 50 lbs. per 2,880 sq. ft. made from, for example, a mixture of ground wood and kraft-bleached wood pulps. Another example is the absorbent, multi-ply toweling paper particularly preferred in U.S. Pat. No. 3,686,025, Morton, issued Aug. 22, 1972 and disclosed in U.S. Pat. No. 3,414,459, Wells, said patents being incorporated herein by reference.

The preferred nonwoven cloth substrates used in the invention herein can generally be defined as adhesively bonded fiberous products, having a web or corded fiber structure (where the fiber strength is suitable to allow carding) or comprising fiberous mats, in which the fibers are distributed haphazardly or in a random array (i.e., an array of fibers in a carded web wherein partial orientation of the fibers is frequently present as well as a completely haphazard distributional orientation) or substantially aligned. The fibers can be natural (e.g., wool, silk, jute, hemp, cotton, linen, sisal, or ramie) or synthetic (e.g., rayon, cellulose ester, polyvinyl derivatives, polyolefins, polyamides, or polyesters). Any diameter or denier of the fiber, generally up to about 10 denier, can be used in the present invention.

Methods of making nonwoven cloths suitable for use herein are not a part of this invention and, being well known in the art, are not described in detail herein. Generally, such cloths are made by dry- or water-laying processes in which the fibers are first cut to desired lengths from long strands, passed into a water or air stream, and then deposited onto a screen, through which the fiber-laden air or water is passed. The deposited fibers are then adhesively bonded together, dried, cured, and otherwise treated as desired to form the nonwoven cloth. Nonwoven cloths made of polyesters, polyamides, vinyl resins, and other thermoplastic fibers can be spun bonded, i.e., the fibers are spun out onto a flat surface and bonded (melted) together by heat or by chemical reactions.

When the substrate component of the fabric conditioning/detergent articles herein is a nonwoven cloth made from fibers deposited haphazardly or in a random array on the screen, the compositions exhibit excellent strength in all directions and are not prone to tear or separate when used in both the washer and the dryer.

Preferably, the nonwoven cloth is water-laid or dry-laid and is made from cellulosic fibers, particularly from regenerated cellulose or rayon, which are lubricated with a standard textile lubricant. Preferably, the fibers are from about 3/16 inch to about 2 inches in length and are from about 1.5 to about 5 denier. It is also preferred that the fibers are at least partially oriented haphazardly, particularly substantially haphazardly, and are adhesively bonded together with a hydrophobic or substantially hydrophobic binder resin, particularly with a nonionic self-crosslinking acrylic polymer or polymers. A preferred cloth comprises by weight about 85% fiber and about 15% binder resin polymer, and has a basis weight of from about 50 to about 90 grams per square yard.

The substrates which are used in the fabric conditioning detergent articles herein, can take a variety of forms. For example, the substrate can be in the shape of a pad, ball or puff, or it can be a sheet or swatch of woven or nonwoven cloth. When the substrate is paper or nonwoven, individual sheets of desired length and width can be used, or a continuous roll of desired width from which a measured length is torn off, may be employed.

The substrates used in the present invention may be formed such that they have slit or aperture openings, in order to improve their functioning in the automatic dryer. Such openings are described in U.S. Pat. No. 3,944,694, McQueary, issued March 16, 1976; U.S. Pat. No. 3,956,556, McQueary, issued May 11, 1976; U.S. Pat. No. 4,007,300, McQueary, issued Feb. 8, 1977; and U.S. Pat. No. 4,012,540, McQueary, issued March 15, 1977, all of which are incorporated herein by reference.

The substrate usable herein can be "dense", or they can be open and have a high amount of "free space". Free space, also called "void volume", is that space within a substrate structure which is unoccupied. For example, certain absorbent, multi-ply paper structures comprise plies embossed with protuberances, the ends of which are mated and joined. This paper structure has free space between the unembossed portions of the plies, as well as between the fibers of the paper plies themselves. A nonwoven cloth also has such space among its fibers. The free space of the substrate can be varied by modifying the density of the fibers of the substrate. Substrates with a high amount of free space generally have low fiber density, and substrates having high fiber density generally have a low amount of free space.

The amount of free space which a material has is not essential to its employment as a substrate herein. However, the amount of free space in the substrate structure may affect the amount of the fabric conditioning components which must be applied to the substrate in order to achieve the required loading effect.

The Surfactant

Preferred laundry articles of the present invention additionally contain a detergent composition which comprises from about 5 to 95% by weight of a water-soluble surface active agent. Any detersive surfactant known in the art may be used in the articles of the present invention. It is preferred that the detergent composition carried by the substrate articles of the present invention contain from about 15 to 90% of the surfactant component, most preferably from about 20 to 85%.

Preferred water-soluble surface-active agents for use in the articles of the present invention include those selected from the group consisting of anionic surfactants, nonionic surfactants, zwitterionic surfactants and mixtures thereof. These water-soluble surfactants include any of the common anionic, nonionic, and zwitterionic detersive surfactants well known in the detergency arts. The surfactants listed in U.S. Pat. No. 3,717,630, Booth, issued Feb. 20, 1973 and U.S. Pat. No. 3,332,880, Kessler et al, issued July 25, 1967, each incorporated by reference, are useful in the present invention. Nonlimiting examples of surfactants suitable for use in the instant compositions are as follows:

Water-soluble salts of the higher fatty acids, i.e., "soaps", are useful as an anionic surfactant herein. This class of surfactants includes ordinary alkali metal soaps such as the sodium, potassium, ammonium, and alkanolammonium salts of higher fatty acids containing from about 8 to about 24 carbon atoms and preferably from about 10 to about 20 carbon atoms. Soaps can be made by direct saponification of fats and oils or by the neutralization of free fatty acids. Particularly useful are the sodium and potassium salts of the mixtures of fatty acids derived from coconut oil and tallow, i.e., sodium or potassium tallow and coconut soaps.

Another class of anionic surfactant includes water-soluble salts, particularly the alkali metal, ammonium and alkanolammonium salts, of organic sulfuric rection products having in their molecular structure an alkyl group containing from about 8 to about 22 carbon atoms and a sulfonic acid or sulfuric acid ester group. (Included in the term "alkly" is the alkyl portion of acyl groups.) Examples of this group of synthetic surfactants which can be used in the present detergent compositions are the sodium and potassium alkyl sulfates, especially those obtained by sulfating the higher alcohols ($C_8$-$C_{18}$ carbon atoms) produced by reducing the glycerides of tallow or coconut oil; and sodium and potassium alkylbenzene sulfonates, in which the alkyl group contains from about 9 to about 15 carbon atoms in straight chain or branched chain configurations, e.g., those of the type described in U.S. Pat. Nos. 2,220,099 and 2,477,383, incorporated herein by reference.

Other anionic surfactant compounds useful herein include the sodium alkyl glyceryl ether sulfonates, especially those ethers or higher alcohols derived from tallow and coconut oil; sodium coconut oil fatty acid monoglyceride sulfonates and sulfates; and sodium or potassium salts of alkyl phenol polyethylene oxide ether sulfate containing about 1 to about 10 units of ethylene oxide per molecule an wherein the alkyl groups contain from about 8 to about 12 carbon atoms.

The alkaline earth metal salts of synthetic anionic surfactants are useful in the present invention. In particular, the magnesium salts of linear alkylbenzene sulfonates, in which the alkyl group contains from 9 to about 15, especially 11 to 13, carbon atoms, are useful.

Other useful anionic surfactants herein include the water-soluble salts of esters of $\alpha$-sulfonated fatty acids containing from about 6 to 20 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; water-soluble salts of olefin sulfonates containing from about 12 to 24 carbon atoms; and $\beta$-alkyloxy alkane sulfonates containing from about 1 to 3 carbon atoms in the alkyl group and from about 8 to 20 carbon atoms in the alkane moiety.

Preferred water-soluble anionic organic surfactants for use herein include linear chain alkylbenzene sulfonates containing from about 10 to 16 carbon atoms in the alkyl group; alkyl sulfates containing from about 10 to 20 carbon atoms; the coconut range alkyl glyceryl sulfonates; and alkyl ether sulfates wherein the alkyl moiety contains from about 10 to 20 carbon atoms and wherein the average degree of ethoxylation varies between about 1 and 6.

Specific preferred anionic surfactants for use herein include: sodium linear $C_{10}$-$C_{12}$ alkylbenzene sulfonate; triethanolamine $C_{10}$-$C_{12}$ alkylbenzene sulfonate; sodium tallow alkyl sulfate; sodium coconut alkyl glyceryl ether sulfonate; and the sodium salt of a sulfated condensation product of $C_{14}$-$C_{18}$ alcohol with from about 1 to about 10 moles of ethylene oxide.

It is to be recognized that any of the foregoing anionic surfactants can either be used separately or in mixtures.

Most commonly, nonionic surfactants are compounds produced by the condensation of an alkylene oxide, especially ethylene oxide (hydrophilic in nature), with an organic hydrophobic compound, which is usually aliphatic or alkyl aromatic in nature. The length of the hydrophilic polyoxyalkylene moiety which is condensed with any particular hydrophobic compound can be readily adjusted to yield a water-soluble compound having the desired degree of balance between hydrophilic and hydrophobic properties. Examples of nonionic surfactants suitable for use herein include:

(1) The polyethylene oxide condensates of alkyl phenols. These compounds include the condensation products of alkyl phenols having an alkyl group containing from about 6 to 12 carbon atoms in either a straight chain or branched chain configuration with ethylene oxide, said ethylene oxide being present in an amount equal to 5 to 25 moles of ethylene oxide per mole of alkyl phenol. The alkyl substituent in such compounds can be derived, for example, from polymerized propylene, diisobutylene, and the like. Examples of compounds of this type include nonyl phenol condensed with about 9.5 moles of ethylene oxide per mole of nonyl phenol; dodecyl phenol condensed with about 12 moles of ethylene oxide per mole of phenol; dinonyl phenol condensed with about 15 moles of ethylene oxide per mole of phenol; and di-isooctylphenol condensed with about 15 moles of ethylene oxide per mole of phenol. Commercially available nonionic surfactants of this type include Igepal C0-630 marketed by the GAF Corporation, and Triton X-45, X-114, X-100 and X-102, all marketed by the Rohm and Haas Company.

(2) The condensation products of aliphatic alcohols with from 1 to about 25 moles of ethylene oxide. The alkyl chain of the aliphatic alcohol can be either straight or branced, primary or secondary, and generally contains from about 8 to about 22 carbon atoms. Examples of such ethoxylated alcohols include the condensation product of about 6 moles of ethylene oxide with 1 mole of tridecanol; myristyl alcohol condensed with about 10 moles of ethylene oxide per mole of myristyl alcohol; the condensation product of ethylene oxide with coconut fatty alcohol wherein the coconut alcohol is a mixture of fatty alcohols with alkyl chains varying from 10 to 14 carbon atoms in length and wherein the condensate contains about 6 moles of ethylene oxide per mole of alcohol; and the condensation product of about 9 moles of ethylene oxide with the above-described coconut alcohol. Examples of commerically available nonionic surfactants of this type include Tergitol 15-S-9 marketed by Union Carbide Corporation, Neodol 23-6.5 marketed by Shell Chemical Company and Kyro EOB marketed by The Procter & Gamble Company.

(3) The condensation products of ethylene oxide with a hydrophobic base formed by the condensation of propylene oxide with propylene glycol. The hydrophobic portion of these compounds has a molecular weiht of from about 1500 to 1800 and exhibits water insolubility. The addition of polyoxyethylene moieties to this hydrophobic portion tends to increase the water-solubility of the molecule as a whole, and the liquid character of the product is retained up to the point where the polyoxyethylene content is about 50% of the total weight of the condensation product, which corresponds to condensation with up to about 40 moles of ethylene oxide. Examples of compounds of this type include certain of the commerically available Pluronic surfactants marketed by Wyandotte Chemicals Corporation.

(4) The condensation products of ethylene oxide with the product resulting from the reaction of propylene oxide and ethylenediamine. The hydrophobic moiety of these products consists of the reaction product of ethylenediamine and excess propylene oxide, said moiety having a molecular weight of from about 2500 to about 3000. This hydrophobic moiety is condensed with ethylene oxide to the extent that the condensation product contains from about 40% to about 80% by weight of polyoxyethylene and has a molecular weight of from about 5,000 to about 11,000. Examples of this type of nonionic surfactant include certain of the commercially available Tetronic compounds marketed by Wyandotte Chemicals Corporation.

Nonionic surfactants may also be of the semi-polar type including water-soluble amine oxides containing one alkyl moiety of from about 10 to 28 carbon atoms and two moieties selected from the group consisting of alkyl groups and hydroxyalkyl groups containing from 1 to about 3 carbon atoms; water-soluble phosphine oxides containing one alkyl moiety of about 10 to 28 carbon atoms and two moieties selected from the group consisting of alkyl groups and hydroxyalkyl groups containing from about 1 to 3 carbon atoms; and water-soluble sulfoxides containing one alkyl moiety of from about 10 to 28 carbon atoms and a moiety selected from the group consisting of alkyl and hydroxyalkyl moieties of from 1 to 3 carbon atoms.

In the detergent compositions used in the instant invention it is preferred that the particular nonionic surfactants employed have a hydrophilic-lipophilic balance (HLB) of from about 8 to about 15. Preferred nonionic surfactants are the condensation products of alkyl phenols, having 6-12 carbon atoms in the alkyl group, with from about 5 to 25 moles of ethylene oxide, and the condensation products of $C_8$-$C_{22}$ aliphatic alcohols with from about 1 to 15 moles of ethylene oxide, and mixtures thereof. Highly preferred nonionic surfactants are the condensation products of at least 5 moles of ethylene oxide with a $C_{10}$-$C_{16}$ aliphatic alcohol.

Another preferred nonionic surfactant herein comprises a mixture of "surfactant" and "co-surfactant" as described in U.S. Patent Application Ser. No. 557,217, Collins, filed Mar. 10, 1975, the disclosure of which is incorporated herein by reference. The term "nonionic surfactant" as employed herein encompasses these preferred mixtures of Collins.

Zwitterionic surfactants include derivatives of aliphatic quaternary ammonium, phosphonium, and sulfonium compounds in which the aliphatic moieties can be straight or branched chain, and wherein one of the aliphatic substitients contains from about 8 to 18 carbon atoms and one contains an anionic water-solubilizing group. Particularly preferred zwitterionic materials are the ethoxylated ammonium sulfonates and sulfates disclosed in U.S. Pat. No. 3,925,262, Laughlin et al, issued Dec. 9, 1975; U.S. Pat. No. 3,929,678, Laughlin et al, issued Dec. 30, 1975; and U.S. Patent Application Ser. No. 603,837, Laughlin et al, filed Aug. 11, 1975, all of which are incorporated herein by reference. The inclusion of these surfactants in the compositions give excellent clay soil removal performance.

Particularly preferred ethoxylated zwitterionic surfactants are those having the formulae:

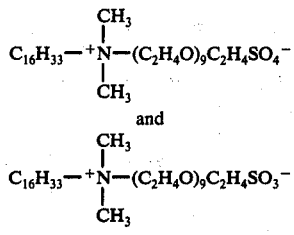

and

Additional preferred zwitterionic surfactants include those having the formula

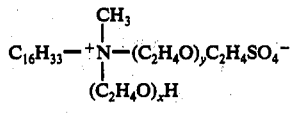

wherein the sum of $x + y$ is equal to about 15.

Quaternary Ammonium Component

The quaternary ammonium fabric softening and antistatic components will normally be employed in the laundry articles of the present invention in an amount of from about 10 to about 90%, preferably from about 15 to about 80%, and most preferably from about 20 to 60% by weight of an intimate mixture with the dispersion inhibitor described below.

The compounds useful herein are quaternary ammonium salts of the formula $[R_1R_2R_3R_4N]^+Y^-$, wherein $R_1$ and preferably $R_2$ represent an organic radical containing a group selected from a $C_{12}$ to $C_{22}$ aliphatic radical or an alkyl phenyl or alkyl benzyl radical having 10 to 16 atoms in the alkyl chain, $R_3$ and $R_4$ represent hydrocarbyl groups containing from 1 to about 4 carbon atoms, or $C_2$ to $C_4$ hydroxyalkyl groups and cyclic structures in which the nitrogen atom forms part of the ring, and Y is an anion such as halide or methylsulfate.

In the context of the above definition, the hydrophobic moiety (i.e. the $C_{12}$ to $C_{22}$ aliphatic, $C_{10}$ to $C_{16}$ alkyl phenol or alkylbenzyl radical) in the organic radical $R_1$ may be directly attached to the quaternary nitrogen atom or may be indirectly attached thereto through an amide, ester, alkoxy, or ether, or like grouping.

The quaternary ammonium antistatic components useful herein include both water-soluble and substantially water-insoluble materials. For example, the imidazolinium compounds of the structure

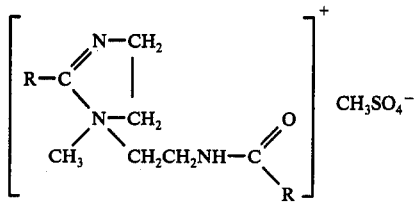

Where R is a $C_{16}$ to $C_{22}$ alkyl group, possesses appreciable water solubility, but can be utilized in the present invention by mixture with the appropriate level and type of organic dispersion inhibitor so as to give an ultimate mixture solubility in water of less than 50 ppm at 25° C. Thus, water-soluble quaternary ammonium compounds may be used in the compositions of the present invention as long as their solubility is adjusted to the proper level by combination with the dispersion inhibitor. Similarly, other relatively water-soluble quaternary ammonium antistatic agents, such as the diisostearyldimethylammonium chlorides disclosed in U.S. Pat. No. 3,395,100, Fisher et al, incorporated herein by reference, may be used in the compositions of the present invention.

However, the preferred quaternary ammonium antistatic components useful herein are characterized by their limited solubility in water. That is to say, such quaternary salts are essentially insoluble in water, existing therein in what appears to be the mesomorphic liquid crystalline state.

The quaternary ammonium antistatic agents used in this invention can be prepared in various ways well known in the art and many such materials are commercially available. The quaternaries are often made from alkyl halide mixtures corresponding to the mixed alkyl chain lengths in fatty acids. For example, the ditallowalkyl quaternaries are made from alkyl halides having mixed $C_{14}$-$E_{18}$ chain lengths. Such mixed di-long chain quaternaries are useful herein and are preferred from a cost standpoint.

Essentially any anionic group can be the counter-ion in the quaternary compounds useful herein. The anionic groups in the quaternary compounds can be exchanged, one for another, using standard anion exchange resins. Thus, quaternary ammonium salts having any desired anion are readily available. While the nature of such anions has no effect on the compositions and processes of this invention, the methyl sulfate and chloride ions are the preferred counter-ions from an availablity standpoint; while the methyl sulfate anion is preferred because of its minimization of corrosive effects on the automatic clothes dryers in which it is used.

The following are representative examples of substantially water-insoluble quaternary ammonium antistatic agents suitable for use in the articles and processes of the present invention. All the quaternary ammonium compounds listed can be included in the articles of the present invention, but the compilation of suitable quaternary compounds hereinafter is only by way of example and is not intended to be limiting of such compounds. Dioctadecyldimethylammonium chloride is an especially preferred quaternary antistatic agent for use herein, by virtue of its high antistatic activity; ditallowalkyldimethylammonium chloride is equally preferred because of its ready availability and its good antistatic activity; other useful di-long chain quaternary compounds are dicetyldimethylammonium chloride, bis-docosyldimethylammonium chloride, didodecyldimethylammonium chloride, ditallowalkyldimethylammonium bromide, dioleoyldimethylammonium hydroxide, ditallowalkyldiethylammonium chloride, ditallowalkyldipropylammonium bromide, ditallowalkyldibutylammonium fluoride, cetyldecylmethylethylammonium chloride, bis- [ditallowalkyldimethylammonium] sulfate, tris-[ditallowalkyldimethylammonium] phosphate, and the like. Particularly preferred quaternary ammonium antistatic components are ditallowalkyldimethylammonium chloride and ditallowalkyldimethylammonium methyl sulfate.

Organic Disperison Inhibitor

The intimate mixture of the quaternary ammonium compound and the dispersion inhibitor used in the present invention comprises from about 10 to about 90%, preferably from about 15 to about 80%, and most preferably 25 to about 80% by weight of the organic dispersion inhibitor component. An amount of dispersion inhibitor sufficient to provide a weight ratio of quaternary ammonium compound to dispersion inhibitor of from about 6:1 to about 1:6, preferably from about 4:1 to 1:4, and most preferably from about 3:1 to 1:3, is employed. The intimate mixture of the quaternary ammonium softening/antistat and dispersion inhibitor components should have a maximum solubility in water of 50 ppm at 25° C, and a softening point in the range of 100° to 200° F.

The dispersion inhibitor itself should also have a maximum solubility in water of 50 ppm at 25° C, and a softening point in the range of 100° to 200° F, preferably 125° to 200° F, most preferably from 150° to 175° F, and is selected from the group consisting of paraffinic waxes, cyclic and acyclic mono- and polyhydric alcohols, substituted and unsubstituted aliphatic carboxylic acids, esters of cyclic and acyclic mono- and polyhydric alcohols and acids, condensates of $C_2$ to $C_4$ alkylene oxide with any of the foregoing types of materials whether or not said materials themselves meet the above solubility and softening point limits, and mixtures thereof.

Preferred herein as a dispersion inhibitor, because of its ready availibility, is tallow alcohol, but other useful dispersion inhibitors include other fatty alcohols in the $C_{14}$ to $C_{26}$ range, such as myristyl alcohol, cetyl alcohol, stearyl alcohol, arachidyl alcohol, behenyl alcohol, and mixtures thereof.

Saturated fatty acids having 12 to 24 carbon atoms in the alkyl chain may also be used as dispersion inhibitors in the present invention. Examples of such compounds include lauric acid, myristic acid, palmitic acid, stearic acid, arachidic acid, and behenic acid, as well as mixtures of these, particularly those derived from naturally occurring sources such as tallow, coconut, and marine oils.

Esters of the aliphatic alcohols and acids are useful dispersion inhibitors, provided they have a total of more than 22 carbon atoms in the acid and alkyl radicals.

Long chain $C_{22}$ to $C_{30}$ paraffinic hydrocarbon materials, such as the saturated hydrocarbon octacosane having 28 carbon atoms can also be used.

Another preferred class of materials useful in the present invention are the water-insoluble sorbitan esters which comprise the reaction product of $C_{12}$ to $C_{26}$ fatty acyl halides, or fatty acids, and the complex mixtures of cyclic anhydrides of sorbital collectively known as "sorbitan". The sorbitan esters are complex mixtures of mono-, di-, tri-, and tetra- ester forms, of which the tri- and tetra- are the least water-soluble and hence the most preferred for the purposes of the present invention. However, commercially available mixtures of the various forms are quite satisfactory provided that the mixture satisfies the water-solubility and melting point range constraints for the organic dispersion inhibitor. Typical fatty acids that are suitable for the alkyl portion of the ester are palmitic, stearic, docosanoic, and behenic acids and mixtures of any of these. These sorbitan esters, particularly the tri- and tetra-esters, provide a degree of fabric softening in addition to their function as dispersion inhibitors. Minor proportions of unsaturated $C_{10}$ to $C_{26}$ fatty acids present in commercially available fatty acid mixtures, such as coconut-, palm-, tallow-, and marine oil-derived acids are also acceptable. Materials of this general class are commercially available under various trade names, such as the Span series sold by Atlas Chemical Corporation. Preferred dispersion inhibitors of this type include the $C_{10}$ to $C_{22}$ alkyl sorbitan esters, for example, sorbitan trilaurate, sorbitan trimyristate, sorbitan tripalmitate, sorbitan tristearate, sorbitan tetralaurate, sorbitan tetramyristate, sorbitan tetrapalmitate, sorbitan tetrastearate, and mixtures thereof. A particularly preferred dispersion inhibitor of this type is sorbitan monostearate. Another preferred group of materials are the $C_{20}$ to $C_{26}$ mono-, and di-ester forms which also provide fabric softening performance in addition to their function as dispersion inhibitors.

The preferred dispersion inhibitors for use in the articles of the present invention include tallow alcohol, sorbitan monostearate and mixtures of them, particularly where the ratio, by weight, of tallow alcohol to sorbitan monostearate is about 1:2. A preferred intimate mixture for use in the articles of the present invention contains ditallowalkyldimethylammonium chloride and tallow alcohol in a ratio, by weight, of about 1:1.

The quaternary ammonium antistatic component and the dispersion inhibitor are applied to the substrate articles of the present invention in the form of an intimate mixture, in an amount effective to yield the desired fabric softening and static control performance. This intimate mixture can be formed by dry mix addition, but a preferred technique involves the comelting of the two materials. The comelting frequently results in the formation, when the mixture is subsequently cooled, of a solid phase which is crystallographically distinct from either of the individual components. This phase is believed to enhance the inhibition of the solubility of the quaternary antistat/organic dispersion inhibitor mixture. Other conventional methods of forming an intimate mixture between the quaternary ammonium compound and the dispersion inhibitor may also be used in making the substrate articles of the present invention. Another method of forming this mixture is by forming a layer of the quaternary ammonium compound on the substrate and completely covering it with a layer of the dispersion inhibitor. However, the quaternary ammonium compound may not be placed in a layer on top of the dispersion inhibitor component.

In applying the surfactant and the intimate mixture described above to the substrate, the components are both impregnated into and coated onto the substrate, such that the areas of the intimate mixture both penetrate into the substrate material and have the proper height above the substrate. The term "coating" connotes the adjoining of the surfactant and intimate mixture components to the surface of the substrate. This coating may be done in strips or in relatively small discrete areas on the substrate surface. "Impregnation" is intended to mean the permeation of the entire substrate structure, internally as well as externally, with the surfactant and quaternary/dispersion inhibitor components. Any conventional methods for coating or impregnating the substrate with these components may be used in forming the articles of the present invention.

The conditioning articles of the present invention are made by loading the quaternary ammonium/dispersion inhibitor intimate mixture onto the substrate, such that the mixture penetrates into the substrate material and extends to a height of from about 1/32 inch to about ½ inch above the substrate surface. Where the areas of the mixture carried by the substrate have a height greater than about ½ inch, they tend to break and chip off from the substrate during the washing and drying process and, hence, lose their softening and static control effectiveness. If is preferred that the height of the intimate mixture be from about 1/16 inch to about ¾ inch, particularly from about 3/32 inch to about ¼ inch, above the substrate. These articles provide an especially efficient method whereby softening and static control benefits may be imparted to laundered fabrics and, therefore, permit the use of lower levels of the quaternary ammonium/dispersion inhibitor mixture. It is preferred that these substrate articles carry from about 0.2 to about 12 grams of the intimate mixture, more preferably from about 0.25 to about 9 grams, most preferably from about 1 to about 6 grams, particularly about 2.5 grams It is also preferred that the intimate mixture cover at least about 1.5 square inches, more preferably at least about 3 square inches, and most particularly at least about 4 square inches, of the outer substrate surface area. In one embodiment, a quaternary ammonium conditioning component and tallow alcohol are heated to about 190°–200° F and are mixed together in a ratio of quat:-tallow alcohol of from about 3:1 to 1:3, particularly about 1:1. The mixture is then placed on the substrate in small spots, such that they penetrate into the substrate layer, and have a height above the substrate of about 3/32 inch.

In a preferred method of making the laundry articles of the present invention, the components are applied to the substrate in liquid form. Thus, components which are normally solid at room temperature should first be melted or dissolved in a solvent prior to application. In preferred articles, the detergent composition, which includes the surfactant component, is applied to the substrate in an amount effective to provide adequate cleaning of the fabrics to be laundered. Preferred articles of the present invention carry from about 3 to about 120 grams, particularly from about 20 to about 80 grams, of the detergent composition. In another method of application, the components are sprayed onto the substrate as it is unrolled. A further method of application is to separately treat a desired number of individual plies (on one or both sides) of a multi-ply substrate and subsequently joining the plies with a known adhesive compound or by sewing or heat-sealing the plies. This provides a composition which can be untreated on one of its outer sides, yet contain within it several other plies, each of which is treated on both sides. It is preferred that the quaternary ammonium/dispersion inhibitor mixture be applied to the outer sides of the substrate used, in order to facilitate the release of the quaternary ammonium component during the drying process.

In one embodiment of the present invention, a two-layer nonwoven substrate is used. The detergent composition is loaded between the layers of the substrate and the outer edges of the substrate are bonded together by glue or heat-sealing. The loading of the detergent composition on the inside of the substrate article, provides a finished product which is neat and easy to handle for the user. The quaternary ammonium/dispersion inhibitor mixture is loaded on an outer surface of the substrate. In this embodiment, the detergent composition may be carried by layers of sponge, foam, paper, woven cloth, or nonwoven cloth contained within the article. Detergent articles having this type of structure are described in U.S. Patent Application Ser. No. 781,378, Flesher and Kingry, filed of even date and incorporated herein by reference. At least one of the substrate used in this embodiment must have an air permeability of at least about 10 cu. ft. per minute per sq. ft., in order to assure proper release of the detergent composition into the laundry solution.

In a preferred embodiment of the present invention, the total components, which are carried by the substrate in the laundry articles of the present invention, contain from about 1 to 30%, preferably from about 3 to 20% and most preferably from about 4 to 15% of the quaternary ammonium/dispersion inhibitor intimate mixture. It is particularly preferred that the total components carried by the substrate contain from about 0.5 to 7% of the quaternary ammonium component.

The detergent compositions, which may be included in the articles of the present invention, may also, in addition to the surfactant component, contain additional adjunct components which are normally found in detergent compositions. Such additional components are applied to the substrate along with the surfactant component, defined above. For example, the detergent compositions may include builder salts, especially alkaline, polyvalent anionic builder salts. These alkaline salts serve to maintain the pH of the cleaning solution in the range of from about 7 to about 12, preferably from about 8 to about 11, and enable the surfactant component to provide effective cleaning even in the presence of hardness cations in the laundry solution. It is preferred that the builder salts are present in an amount of from about 1 to 60%, more preferably about 15 to 35%, by weight of the detergent compositions used in the present invention; although by the proper selection of surfactants and other components, effective detergent compositions, which are free or essentially free of builder salts, may be formulated for use herein.

Suitable detergent builder salts useful herein can be of the polyvalent inorganic or polyvalent organic types, or mixtures thereof. Nonlimiting examples of suitable water-soluble, inorganic alkaline detergent builder salts include alkali metal carbonates, borates, phosphates, polyphosphates, bicarbonates, silicates, and sulfates. Specific examples of such salts include the sodium and potassium tetraborates, perborates, bicarbonates, carbonates, tripolyphosphates, orthophosphates, pyrophosphates, and hexametaphosphates.

Examples of suitable organic alkaline detergency builder salts are:

(1) water-soluble aminopolyacetates, e.g., sodium and potassium ethylenediamine tetraacetates, nitrilotriacetates, and N-(2-hydroxyethyl) nitrilotriacetates;
(2) water-soluble salts of phytic acid, e.g., sodium and potassium phytates; and (3) water-soluble polyphosphonates, including sodium, potassium and lithium salts of ethane-1-hydroxy-1, 1-diphosphonic acid; sodium, potassium and lithium salts of methylenediphosphonic acid; and the like.

Additional organic builder salts useful herein include the polycarboxylate materials described in U.S. Pat. No. 3,364,103, incorporated herein by reference, including the water-soluble alkali salts of mellitic acid. The water-soluble salts of polycarboxylate polymers and copolymers, such as are described in U.S. Pat. No. 3,308,067, incorporated herein by reference, are also suitable as builders. It is to be understood that while the alkali metal salts of the foregoing anionic detergents and organic and inorganic polyvalent anionic builder salts are preferred for use herein from an economic standpoint, the ammonium, and alkanolammonium, e.g., triethanolammonium, diethanolammonium, monoethanolammonium, and the like, water-soluble salts of any of the foregoing detergent and builder anions are also useful herein.

A further class of detergency builder materials useful in the present invention are insoluble sodium aluminosilicates, particularly those described in Belgian Pat. No. 814,874, issued Nov. 12, 1974, incorporated herein by reference. This patent discloses and claims detergent compositions containing sodium aluminosilicates of the formula $Na_Z(AlO_2)_Z(SiO_2)_Y \cdot XH_2O$ wherein Z and Y are integers equal to at least 6, the molar ratio of Z to Y is in the range of from 1.0:1 to about 0.5:1, and X is an integer from about 15 to about 264, said aluminosilicates having a calcium ion exchange capacity of at least 200 mg. eq./gram and a calcium ion exchange rate of at least about 2 grains/gallon/minute/gram. A preferred material is $Na_{12}(SiO_2 \cdot AlO_2)_{12} \cdot 27H_2O$.

Mixtures of organic and/or inorganic builders may be used herein. One such mixture of builders is disclosed in Canadian Pat. No. 755,038, and consists of a ternary mixture of sodium tripolyphosphate, trisodium nitrilotriacetate and trisodium ethane-1-hydroxy-1,1-diphosphonate.

Other preferred builder materials which may be used in the articles of the present invention include alkali metal carboxymethyltartronates, commercially available as about 76% active together with about 7% ditartronate, about 3% diglycolate, about 6% sodium carbonate and about 8% water; and anhydroussodium carboxymethylsuccinate, commercially available as about 76% active together with about 22.6% water and a mixture of other organic materials, such as carbonates.

While any of the foregoing alkaline polyvalent builder materials are useful herein, sodium tripolyphosphate, sodium nitrilotriacetate, sodium mellitate, sodium citrate, and sodium carbonate are preferred herein for use as builders. Sodium tripolyphosphate is especially preferred herein as a builder, both by virtue of its detergency building activity and its ability to suspend illite and kaolinite clay soils and to retard their redepositon on the fabric surface.

Bleaching agents may also be incorporated in the detergent compositions used in the present invention. Examples of typical bleaching agents are chlorinated trisodium phosphate and the sodium and potassium salts of dichloroisocyanuric acid.

The detergent compositions useful in the present invention may also contain other adjunct materials commonly used in such compositions. Examples of such components include various soil-suspending agents, such as carboxymethylcellulose, corrosion inhibitors, dyes, fillers such as sodium sulfate and silica, optical brighteners, germicides, pH adjusting agents, enzymes, enzyme stabilizing agents, perfumes, and the like. In addition, up to about 5%, preferably from about 0.3% to about 1%, of $TiO_2$ may be added to paste or liquid detergent compositions used in the present invention to inhibit bleeding through the substrate layers.

The substrate compositions of the present invention are used in both the automatic washer and dryer and yield fabric softening and static control benefits to the fabrics laundered with them. When the detergent composition, including the surfactant component, is included on the substrate, the articles of the present invention also provide cleaning benefits to the fabrics being laundered with it. The substrate composition is placed in the automatic washing machine together with the fabrics to be laundered, preferably at the start of the washing cycle, and is allowed to remain there until the washing cycle is completed. During this process, the surfactant and adjunct components which are contained on the substrate are released into the washing solution and provide a cleaning benefit to the fabrics washed therein, while the intimate mixture is held substantially intact on the substrate. The fabrics and the same substrate are then tumbled, under heat, in an automatic dryer until the fabrics are dry. In the course of the drying process, the antistat/dispersion inhibitor mixture, carried on the substrate, softens as the fabrics and the substrate approach the dryer air temperature and the tumbling action of the dryer causes this mixture to deposit onto the fabrics, thus distributing the quaternary ammonium component over the surface of the fabrics and minimizing the buildup of static charges on them.

All percentages, parts, and ratios herein are by weight unless otherwise specified.

The following nonlimiting examples illustrate the articles and the method of the present invention.

EXAMPLE I

Cleaning and conditioning substrate articles were made by coating about 35 grams of a detergent composition, having the formulation given below, on the one side of an 8 × 11 sheet of a Scott Industrial Towel, made of wood pulp, rayon and latex binder. An identical sheet of the same type of towel was placed on top of the coated sheet, and the edges of the two sheets were sewn together, so as to completely enclose the detergent composition between the two substrate sheets.

| Component | % by weight |
|---|---|
| Condensation product of $C_{14-15}$ alcohol with average 7 moles of ethylene oxide per mole of alcohol (Neodol 45-7) | 28.3 |
| Triethanolamine | 6.6 |
| Magnesium $C_{11.8}$ linear alkylbenzene sulfonate | 59.0 |
| Tallow fatty acid | 1.9 |
| Moisture and minors | 4.2 |

A fabric softening and static control mixture was formulated bycomelting and mixing ditallowalkyldimethylammonium chloride and tallow alcohol, in a ratio of about 3:1, at a temperature of about 190°-200° F.

Three different types of articles were formulated using the intimate mixture and the substrate articles formulated above. Each of the articles contained 2.5 grams of the quaternary ammonium/dispersion inhibitor intimate mixture. Article A was made by placing 1 inch to 1¼ inch wide strips of the intimate mixture along the 8 inch edges of the substrate articles, using a gravure printing process. The strips covered about 40 sq. in. of the substrate surface, did not penetrate into the substrate material, and were less than 1/32 inch in height. Article B was made by placing 24 spots of the intimate mixture on the substrate surface, such that they covered about 4 sq. in. of the substrate surface. The spots penetrated into the substrate material, and each had a diameter of about 3/8 inch and a thickness of about 1/32 to 1/16 inch above the substrate surface. Article C was formulated by hand coating the intimate mixture in 1 inch to 1¼- inch wide strips along the 8 inch substrate edges such that about 40 sq. in. of the substrate surface was covered by the mixture. There was some penetration of the mixture into the substrate material, and the strips had a height of less than 1/32 inch.

Each of the substrate articles was then used to launder fabrics, under identical conditions, using a Kenmore Automatic Washing Machine. For each run a standard 5½ lb. load of clothing, containing synthetic, natural, and blended fiber garments, was washed in a regular agitation cycle, in 100° F wash water which had a hardness of 7 grains of mixed calcium and magnesium per gallon of water. Each load of clothing, together with its substrate article, was then transferred to a Kenmore Electric Dryer and was dried for 50 minutes at a maximum temperature of about 155° F. The test procedures were carried out at a relative humidity of about 30–35%.

The dried clothes were then inserted in a Faraday Cage Voltage Sensing Basket and the voltage level change was measured as each item of clothing was removed from the Faraday Cage, yielding the total voltage charge per wash load. The total voltage charge was then divided by the amount of fabric surface area in the wash load to calculate the voltage per area. In addition, the number of static clings taking place as individual clothing articles were removed from the dryer was recorded for each wash load. Lower voltage per area and static cling figures denote better static control performance by the composition utilized in the washing/drying process. The results for each of the articles is summarized in the table below.

| Article | Voltage/yd.$^2$ | # fabric clings |
|---|---|---|
| A | 2.1 | 2 |
| B | 0.4 | 0 |
| C | 1.4 | 0 |

The data indicate that improved static control results are obtained where laundry/fabric conditioning substrate articles are formulated according to the present invention, such that the fabric conditioner/dispersion inhibitor mixture penetrates into the substrate material and has a height above the substrate material of from about 1/32 inch to about ½ inch.

Substantially similar static control results are obtained where Article B is formulated such that the quaternary ammonium/dispersion inhibitor spots are about ⅛ inch or about ¼ inch in height, and also where the spots cover about 3 sq. inches or about 6 sq. inches of the substrate surface area. Comparable results are also obtained where the ratio by weight of ditallowalkyldimethylammonium chloride to tallow alcohol is about 1:1.

Substantially similar results are obtained where the detergent composition carried by the substrate article includes anionic surfactants, particularly sodium, calcium, or magnesium-neutralized anionic surfactants, such as $C_{10-16}$ branched chain alkylbenzene sulfonates, $C_{10-16}$ alkyl sulfates, or $C_{10-16}$ alkyl ether sulfates.

Comparable results are also obtained where the detergent composition contains a nonionic surfactant such as a secondary $C_{11-15}$ alcohol condensed with 9 moles of ethylene oxide (Tergitol 15-S-9), the condensation product of $C_{12-13}$ alcohol with an average of 5 moles of ethylene oxide, wherein the mono- and unethoxylated fractions are stripped away (Neodol 23-3T), or the condensation product of nonylphenol with 9 moles of ethylene oxide (Igepal CO-630).

Similar results are obtained where the detergent composition carried by the substrate articles contains a builder component such as a water-insoluble aluminosilicate builder, e.g., hydrated sodium Zeolite A with an average particle size of 1-10 microns, sodium pyrophosphate, sodium carbonate, or sodium 2-oxy-1,1,3-propane tricarboxylate.

Similar results are also obtained where the quaternary ammonium component used in the substrate article is ditallowalkyldimethylammonium methyl sulfate, dicetyldimethylammonium chloride, didodecyldimethylammonium chloride, ditallowalkyldimethylammonium bromide, dioleoyldimethylammonium hydroxide, ditallowalkyldipropylammonium chloride, ditallowalkyldibutylammonium fluoride, or cetyldecylmethylethylammonium chloride.

Comparable results are also obtained where the dispersion inhibitor used in the substrate article is replaced by myristyl alcohol, cetyl alcohol, stearyl alcohol, lauric acid, myristic acid, palmitic acid, stearic acid, sorbitan trilaurate, sorbitan trimyristate, sorbitan tripalmitate, or sorbitan tetrastearate.

EXAMPLE II

A substrate article, for use in both the washer and the dryer, having the composition defined below, is made as follows:

| Component | % by weight |
|---|---|
| Neodol 45-7 | 25.4 |
| Triethanolamine | 5.9 |
| Magnesium $C_{11.8}$ linear alkylbenzene sulfonate | 53.0 |
| Tallow fatty acid | 1.7 |
| $TiO_2$ | 0.5 |
| Moisture and minors | 3.6 |
| Fabric conditioning mixture: | |
| Ditallowalkyldimethylammonium methyl sulfate | 5.2 |
| Tallow alcohol | 2.5 |
| Sorbitan monostearate | 2.2 |

An 11 inch × 11 inch bottom sheet, made of melt-blown polypropylene, is loaded with about 33 grams of the detergent composition described above, in the form of an essentially anhydrous paste. The paste is thinly spread over the surface of one side of the substrate, leaving a clean perimeter edge approximately ½ inch wide. The fabric conditioning mixture, described above, is formed by comelting and mixing the components at a temperature of about 140°–160° F. The mixture is loaded onto a second sheet of the polypropylene substrate material, in four rows of six dots. The dots penetrate into the substrate material, have a height above the substrate of about ⅜, and cover about 4 sq. inches of the substrate surface area. Approximately 4.4 grams of the fabric conditioning mixture is loaded onto the substrate sheet. The two treated substrate sheets are then bonded together such that the spots of the static control agent/-dispersion inhibitor mixture are on the outside surface and the detergent composition is contained within the finished article, by bonding the outer edges of both substrate sheets together by heat sealing.

This substrate article provides cleaning and excellent fabric softening and static control performance when it is placed in an automatic washing machine with a load of soiled fabrics at the beginning of the washing cycle and is subsequently transferred to an automatic dryer and dried with the fabrics.

EXAMPLE III

A substrate article of the present invention, containing the detergent and static control compositions described below, was made by the following method:

| Component | % by weight |
|---|---|
| Sodium $C_{11.8}$ alkylbenzene sulfonate | 13.2 |
| $C_{14-16}$ ethoxylated alkyl sulfate | 6.9 |
| Sodium silicate solids (2.0r) | 13.2 |
| Tallow fatty acid | 0.55 |
| Sodium tripolyphosphate | 26.9 |
| Fabric conditioning mixture: | |
| Ditallowalkyldimethyl-ammonium methyl sulfate | 1.1 |
| Sorbitan monostearate | 2.7 |
| Tallow alcohol | 1.3 |
| Moisture and minors | balance to 100 |

An intimate mixture of the ditallowalkyldimethylammonium methyl sulfate, sorbitan monostearate and tallow alcohol components is made by mixing and comelting process. About 1.8 grams of the mixture is placed on each of two sheets of a Scott 8050 Industrial Towel in the form of a row of 10 dots, which penetrate into the substrate material and which have a height of about ¼ inch above the substrate surface. A total of about 6 sq. inches of the substrate are covered with the mixture. One of the substrate sheets is then coated with about 70 grams of the detergent composition, described above, on its side which does not carry the fabric conditioning mixture. The second substrate sheet is then placed on top of this sheet such that the detergent composition is contained between the two substrates and all of the fabric conditioning mixture spots are on the outside of the final article. The two sheets are bonded together by sewing around their outer perimeter edges. This substrate article is found to give particularly beneficial cleaning, softening, and static control performance when used sequentially in an automatic washing machine and automatic clothes dryer in the laundering process.

EXAMPLE IV

A substrate article of the present invention is formulated in the following manner. An intimate mixture of ditallowalkyldimethylammonium chloride and tallow alcohol, in a ratio by weight of about 1:1, is made by comelting and mixing the components at a temperature of about 190°-200° F. About 4.4 grams of this mixture is loaded onto a commercially marketed paper towel in a series of small dots, such that about 4 sq. inches of the substrate surface area is covered by the mixture. The dots are about ¼ inch in diameter, penetrate into the substrate material, and have a height of about 3/16 inch above the substrate surface.

This substrate article is added to an automatic washing machine with a load of soiled clothes together with a conventional laundry detergent composition, and a complete washing cycle is run. The clothes, together with the substrate article, are then transferred to an electric clothes dryer, which is run until the clothing is dry. It is found that the substrate article acts to impart an excellent fabric softening and static control benefit to the laundered fabrics.

What is claimed is:

1. A laundry article, providing fabric softening and static-control benefits, for use in both the washer and the dryer, consisting essentially of a water-insoluble substrate, carrying an effective amount of an intimate mixture, having a maximum solublity in water of 50 ppm at 25° C and a softening point of from 100° to 200° F, consisting essentially of:

(a) from about 10 to 90% by weight of quaternary ammonium fabric conditioning compounds having the formula $[R_1R_2R_3R_4N]^+Y^-$, wherein at least one, and not more than two, of the $R_1$, $R_2$, $R_3$, or $R_4$ groups is an organic radical containing a group selected from a $C_{12}$ to $C_{22}$ aliphatic radical, or an alkyl phenyl or alkyl benzyl radical having 10 to 16 carbon atoms in the alkyl chain, the remaining group or groups being selected from $C_1$ to $C_4$ alkyl, $C_2$ to $C_4$ hydroxy alkyl, and cyclic structures in which the nitrogen atom forms part of the ring, Y constitutes an anionic radical selected from the group consisting of hydroxide, halide, sulfate, methyl sulfate, and phosphate ions; and (b) from about 10 to 90% by weight of a dispersion inhibitor, being a solid organic material having a maximum solubility in water of 50 ppm at 25° C and a softening point in the range of 100° F to 200° F, said material being selected from the group consisting of paraffinic waxes, cyclic and acyclic mono- and polyhydric alcohols, substituted and unsubstituted aliphatic carboxylic acids, esters of cyclic and acyclic mono- and polyhydric alcohols and acids, condensates of $C_2$ to $C_4$ alkylene oxide with any of the foregoing types of materials, whether or not said materials themselves meet the above solubility and softening point limits, and mixtures thereof;

said intimate mixture penetrating into the substrate and extending above the substrate to a height of from about 1/32 inch to about ½ inch.

2. An article according to claim 1 wherein the substrate is made of a flexible water-insoluble, wet-strength paper, woven cloth or nonwoven cloth.

3. An article according to claim 2 wherein the substrate carries from about 0.2 to about 12 grams of the intimate mixture.

4. An article according to claim 3 wherein the intimate mixture covers at least about 1.5 square inches of the substrate surface area.

5. An article according to claim 5 wherein the weight ratio of quaternary ammonium compound to dispersion inhibitor is in the range of from about 4:1 to 1:4.

6. An article according to claim 5 wherein the weight ratio of quaternary ammonium compound to dispersion inhibitor is in the range of from about 3:1 to 1:3.

7. An article according to claim 6 wherein the intimate mixture covers at least about 3 square inches of the substrate surface area.

8. An article according to claim 7 wherein the intimate mixture covers at least about 4 square inches of the substrate surface area.

9. An article according to claim 8 wherein the intimate mixture extends above the substrate to a height of from about 1/16 inch to about ⅜ inch.

10. An article according to claim 9 wherein the substrate carries from about 0.25 grams to about 9 grams of the intimate mixture.

11. An article according to claim 10 wherein the substrate carries from about 1.0 to about 6 grams of the intimate mixture.

12. An article according to claim 11 wherein the intimate mixture is formed from a comelt of the quaternary ammonium compound and the dispersion inhibitor.

13. An article according to claim 12 wherein the quaternary ammonium compound is selected from the group consisting of ditallowalkyldimethylammonium chloride, ditallowalkyldimethylammonium methyl sulfate, and dioctadecyldimethylammonium chloride.

14. An article according to claim 13 wherein the dispersion inhibitor is selected from the group consisting of tallow alcohol, $C_{10}$ to $C_{22}$ alkyl sorbitan esters, and mixtures thereof.

15. An article according to claim 14 wherein the intimate mixture extends above the substrate to a height of from about 3/32 inch to about ¼ inch.

16. An article according to claim 15 wherein the substrate carries about 2.5 grams of the intimate mixture.

17. An article according to claim 16 wherein the dispersion inhibitor is tallow alcohol.

18. An article according to claim 17 wherein the substrate additionally carries a laundry detergent composition comprising from about 5 to 95% of a water-soluble surface-active agent.

19. A method for providing fabric softening and static control benefits to fabrics, comprising the steps of:

(a) agitating said fabrics in a aqueous laundry solution to which has been added a substrate laundry article consisting essentially of a water-insoluble substrate, carrying an effective amount of an intimate mixture, having a maximum solubility of 50 ppm at 25° C, and a softening point of from 100° to 200° F, consisting essentially of:

(i) from about 10 to 90% by weight of a quaternary ammonium fabric conditioning compound having the formula $[R_1R_2R_3R_4N^+Y^-]$, wherein at least one, and not more than two, of the $R_1$, $R_2$, $R_3$, or $R_4$ groups is an organic radical containing a group selected from a $C_{12}$ to $C_{22}$ aliphatic radical, or an alkyl phenyl or alkyl benzyl radical having 10 to 16 carbon atoms in the alkyl chain, the remaining group or groups being selected from $C_1$ to $C_4$ alkyl, $C_2$ to $C_4$ hydroxy alkyl, and cyclic structures in which the nitrogen atom forms at least part of the ring, and Y constitutes an anionic radical selected from the group consisting of hydroxide, halide, sulfate, methyl sulfate, and phosphate ions; and (ii) from about 10 to 90% by weight of a dispersion inhibitor, being a solid organic material having a maximum solubility in water of 50 ppm at 25° C and a softening point in the range of 100° F to 200° F, said material being selected from the group consisting of paraffinic waxes, cyclic and acyclic mono- and polyhydric alcohols, substituted and unsubstituted aliphatic carboxylic acids, esters of cyclic and acyclic mono- and polyhydric alcohols and acids, condensates of $C_2$ to $C_4$ alkylene oxide with any of the foregoing types of materials, whether or not said materials themselves meet the above solubility and softening point limits, and mixtures thereof, said intimate mixture being penetrated into the substrate and having a height above the substrate of from about 1/32 inch to about ½ inch; and (b) tumbling said fabrics, under heat, in a laundry dryer together with said substrate composition.

20. A method according to claim 19 wherein the substrate carries from about 0.2 to about 12 grams of the intimate mixture.

21. A method according to claim 20 wherein the intimate mixture covers at least about 4 square inches of the substrate surface area.

22. A method according to claim 21 wherein the intimate mixture extends above the substrate to a height of from about 1/16 inch to about ⅜ inch.

23. A method according to claim 22 wherein the substrate additionally carries a detergent composition comprising from about 5 to 95% of a water-soluble surface-active agent.

* * * * *

UNITED STATES PATENT AND TRADEMARK OFFICE

CERTIFICATE OF CORRECTION

PATENT NO. : 4,113,630

DATED : September 12, 1978

INVENTOR(S) : Clifford K. Hagner and Richard B. Wissel

It is certified that error appears in the above-identified patent and that said Letters Patent are hereby corrected as shown below:

Column 1, line 31, "eleminating", should be -- eliminating --.

Column 3, line 53, "etail", should be -- detail --.

Column 3, line 53, "Substrates", should be underlined -- Substrates --.

Column 8, line 6, "weiht", should be --weight --.

Column 10, line 40, "$C_{14}$-$E_{18}$", should be -- $C_{14}$-$C_{18}$ --.

Column 11, line 68, "sorbital", should be -- sorbitol --.

Column 13, line 21, "3/4 inch", should be -- 3/8 inch --.

Column 15, line 47, "anhydroussodium", should be -- anhydrous sodium --.

Column 16, line 62, "bycomelting", should be -- by comelting --.

Column 20, line 60, Claim 5, "claim 5", should be -- claim 4 --.

Signed and Sealed this

*Twelfth* Day of *December 1978*

[SEAL]

*Attest:*

RUTH C. MASON
*Attesting Officer*

DONALD W. BANNER
*Commissioner of Patents and Trademarks*